US008635995B2

(12) United States Patent
Kühne

(10) Patent No.: US 8,635,995 B2
(45) Date of Patent: Jan. 28, 2014

(54) OVEN HAVING A UNIFORM HOT AIR FLOW IN THE PREPARATION SPACE

(75) Inventor: Johannes Antonius Maria Kühne, GE Sleeuwijk (NL)

(73) Assignee: Koninklijke Fabriek Inventum B.V., Nieuwegein (NL)

( * ) Notice: Subject to any disclaimer, the term of this patent is extended or adjusted under 35 U.S.C. 154(b) by 1203 days.

(21) Appl. No.: 11/918,953

(22) PCT Filed: Apr. 22, 2005

(86) PCT No.: PCT/NL2005/000303

§ 371 (c)(1),
(2), (4) Date: May 5, 2008

(87) PCT Pub. No.: WO2006/112692

PCT Pub. Date: Oct. 26, 2006

(65) Prior Publication Data

US 2009/0064984 A1 Mar. 12, 2009

(51) Int. Cl.
*F24C 15/32* (2006.01)

(52) U.S. Cl.
USPC .. 126/21 A; 126/21 R; 126/39 D; 126/273 R; 432/176; 432/199; 219/400; 99/474

(58) Field of Classification Search
USPC ..... 126/21 A, 21 R, 39 D, 273 R; 432/176, 432/199; 219/400, 401; 99/474, 475, 476
See application file for complete search history.

(56) References Cited

U.S. PATENT DOCUMENTS

| | | | | | |
|---|---|---|---|---|---|
| 2,491,420 | A | | 12/1949 | Scott | |
| 3,719,180 | A | * | 3/1973 | Pere | 126/21 A |
| 3,759,241 | A | | 9/1973 | Berkhoudt | |
| 4,813,398 | A | | 3/1989 | Savage | |
| 5,111,012 | A | * | 5/1992 | Hyun et al. | 219/757 |
| 5,497,760 | A | * | 3/1996 | Alden et al. | 126/21 A |
| 5,601,070 | A | * | 2/1997 | Hotard et al. | 126/21 A |
| 5,786,567 | A | * | 7/1998 | Wang | 219/400 |
| 5,857,455 | A | * | 1/1999 | Mann | 126/21 A |
| 6,054,686 | A | | 4/2000 | Pauly et al. | |
| 6,718,965 | B2 | * | 4/2004 | Rummel et al. | 126/21 A |
| 2003/0140917 | A1 | | 7/2003 | Rummel et al. | |

FOREIGN PATENT DOCUMENTS

| | | |
|---|---|---|
| DE | 198 31 087 | 1/2000 |
| EP | 0 701 388 | 9/2000 |
| WO | WO 2005/050093 | 6/2005 |

* cited by examiner

*Primary Examiner* — Avinash Savani
(74) *Attorney, Agent, or Firm* — Harness, Dickey & Pierce, P.L.C.

(57) ABSTRACT

An oven for use in an aircraft is disclosed, including a preparation space. A fan and a heater are located behind a separating wall. The separating wall has at least one of the following devices for enhancing the uniformity of air flow: —a throat around a central air intake opening in the separating wall—the separating wall provided with end edges which run close to the side walls of the preparation space and which are curved or bent towards the preparation space—flow guides extending along an edge of the separating wall and directed away from the preparation space.

20 Claims, 4 Drawing Sheets

OVEN HAVING A UNIFORM HOT AIR FLOW IN THE PREPARATION SPACE

Figure 1:
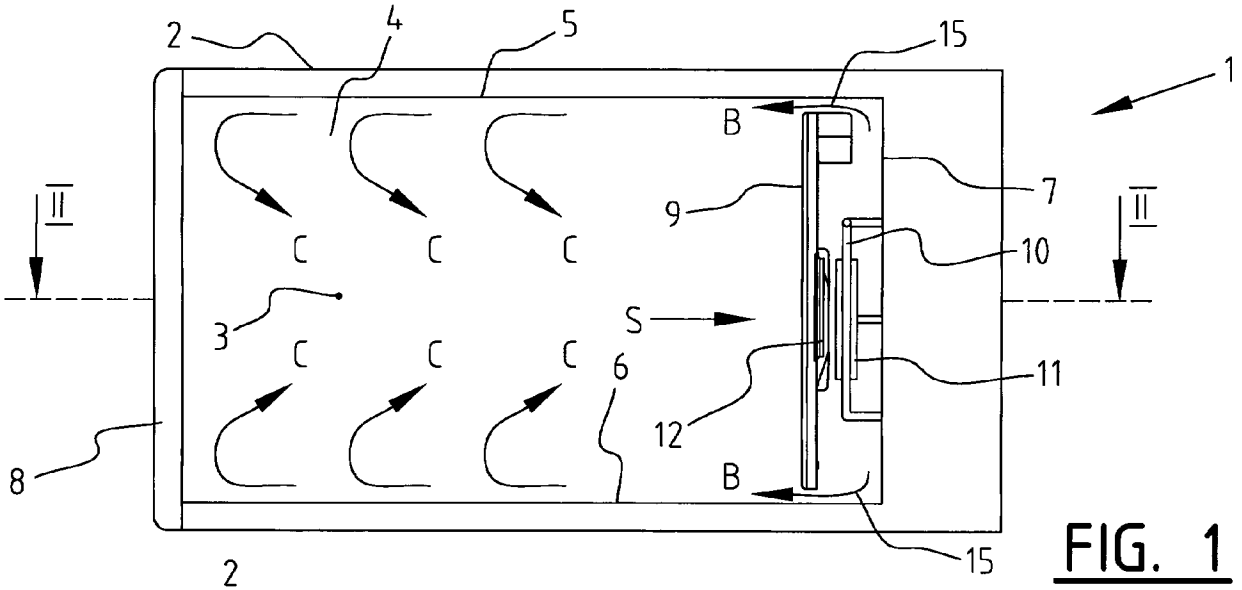

The invention relates to an oven, in particular for use in an aircraft, comprising a preparation space, a device for causing circulation of air through the preparation space and a device co-acting therewith for heating the circulation air, wherein the air circulation device comprises at least one fan and at least one separating wall placed between the fan and the preparation space. Such an oven is generally known.

The known oven comprises a housing in which a preparation space or inner oven is arranged. The preparation space is bounded by side walls, an upper wall, a bottom and a rear wall. The open side of the preparation space opposite the rear wall is closed by a door. Placed some distance in front of the rear wall is a separating wall which usually takes the form of a flat plate, optionally having walls which are bent perpendicularly.

Against the rear wall are arranged electrical heating elements, in addition to a fan with which air can be drawn out of the preparation space and blown along the heating elements back into the preparation space. The separating wall is provided for this purpose with a suction opening formed opposite the fan, and this wall is clear of the peripheral walls of the preparation space, so that outlet slots are defined therebetween.

Professional ovens, such as ovens in aircraft, must be able in a short time to heat a large number of prepared, packed meals, which are transported in cooled or frozen form, to a temperature suitable for consumption. These meals are often placed dozens at a time in racks in the preparation space of the oven, which is thereby completely filled.

A problem which occurs with such ovens is that the close stacking of the meals, between which hardly any space is left clear, has an adverse effect on the circulation of the air through the preparation space. Some parts of the preparation space are hereby covered by the hot airflow, while others are not, or hardly so. This has the result that the temperature distribution in the preparation space can be extremely uneven.

Because it is of great importance for the health of passengers that every meal is in any case heated to a minimum temperature at which the food can be safely consumed, the meals at the locations in the preparation space which are least accessible by the hot airflow represent a measure for the heating power to be used and the time required in the oven. At this power and treatment time meals situated at more readily accessible locations are therefore in fact heated unnecessarily.

Great temperature differences between the meals, which will be served simultaneously, are however undesirable and impractical. Unnecessary heating of meals further results in energy loss, while the processing time, which is in fact too long, moreover has the consequence that some of the passengers will have to wait a long time for the meal.

The invention therefore has for its object to improve an oven of the above described type such that the stated drawbacks do not occur, or only to a lesser degree. According to the invention this is achieved with such an oven in that the separating wall has means for enhancing the uniformity of the hot airflow in the preparation space. A uniform distribution of the hot air over the whole preparation space can be achieved by adapting the separating wall in appropriate manner, whereby the meals in the preparation space are all heated to about the same extent.

According to a first aspect of the invention, the separating wall has at least one opening for drawing air out of the preparation space, and the uniformity enhancing means comprise a throat connected to this suction opening. By having the suction opening debouch into an aerodynamically formed throat a uniform supply of air to the fan is ensured, and thereby also a uniform discharge of air out of the preparation space.

According to a second aspect of the invention, the separating wall extends substantially vertically and the uniformity-enhancing means comprise end edges of the separating wall which run close to side walls of the preparation space and which have a form curved or bent toward the preparation space relative to a main plane of the separating wall. These curved or bent end edges ensure that the flow direction of hot air flowing along the sides of the separating wall to the preparation space is gradually deflected, whereby pressure losses remain limited and turbulence is prevented.

In addition or instead, the uniformity-enhancing means in the oven according to the invention can comprise at least one flow guide extending along an edge of the separating wall and directed away from the preparation space. This flow guide ensures that the heated air can flow round the edges of the separating wall only at determined locations, thereby enhancing a desired distribution of hot air in the preparation space.

The at least one flow guide is preferably placed here substantially at the position of the fan. At points where the edges lie closest to the fan and the flow speed of the air is therefore relatively high, the airflow is thus deflected to edge parts further removed from the fan.

For an optimal airflow along the flow guide(s), this/these latter preferably has/have a middle part extending substantially transversely of the separating wall and at least one end part which fans out.

According to a first variant, the at least one flow guide extends substantially vertically along an end edge of the separating wall. The in principle horizontal flow of the hot air can thus be regulated and directed round the side edges of the separating wall. In this case the at least one flow guide preferably extends over only a part of the height of the separating wall, so that the air can flow unhindered over the remainder of the height to the preparation space.

According to a second variant, the at least one flow guide extends substantially horizontally along an upper edge of the separating wall. This prevents too much hot air finding its way to the preparation space along the top side. It is advantageous here when the at least one flow guide extends substantially over the whole width of the separating wall.

For the best possible guiding of the airflow, which will have a rotation component due to the rotation of the fan, the at least one flow guide can have a wave-like progression. The middle part of the horizontal flow guide thus runs almost concentrically with the fan, while the edges thereof run upward to allow the air to flow away over the whole height of the separating wall.

Finally, the invention further relates to a separating wall with uniformity enhancing means which is evidently intended for application in an oven as described above.

Figure 2:
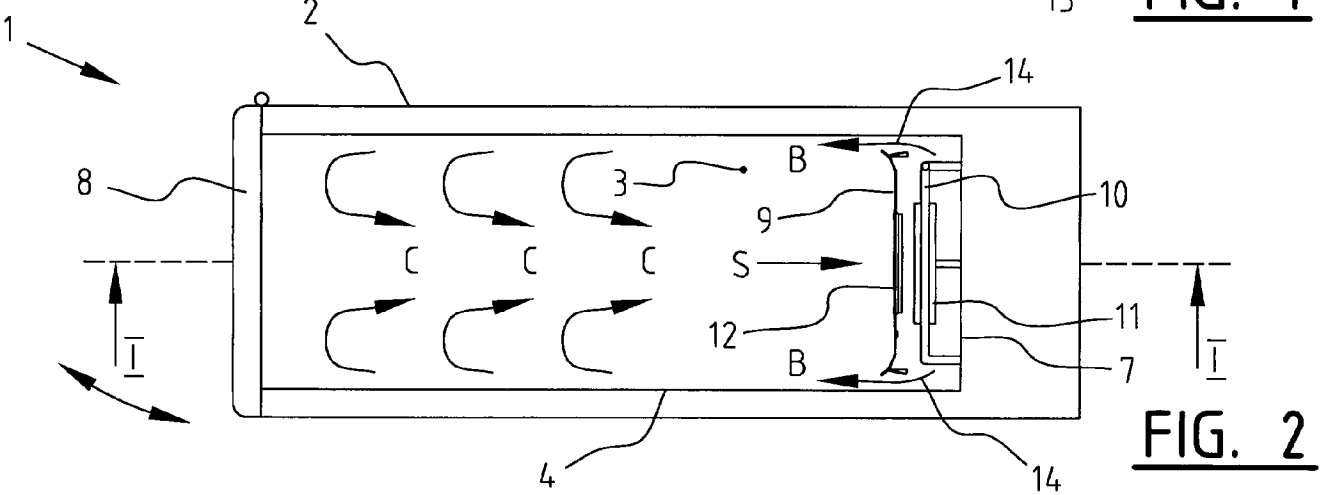
Figure 3:
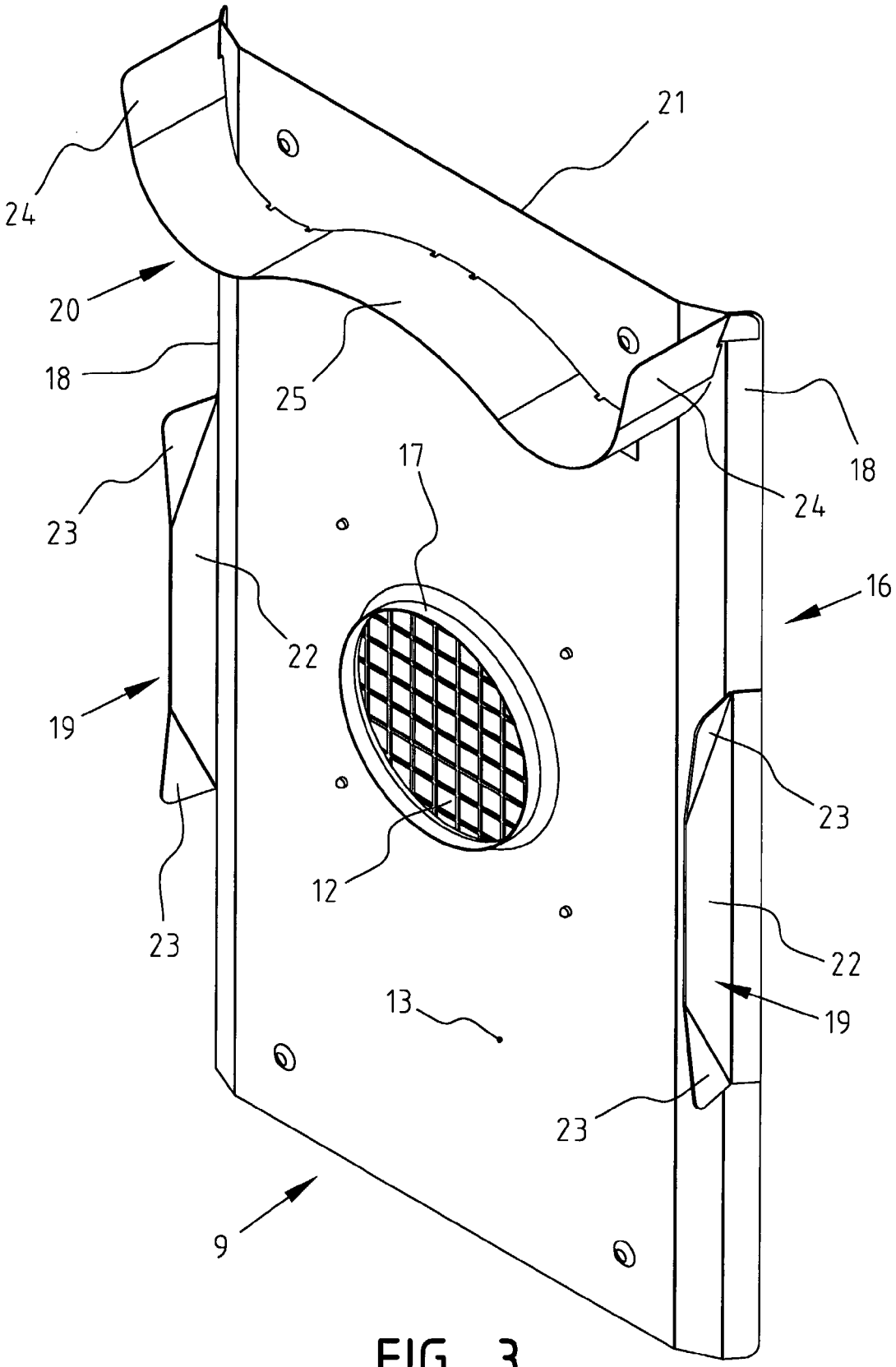
Figure 4:
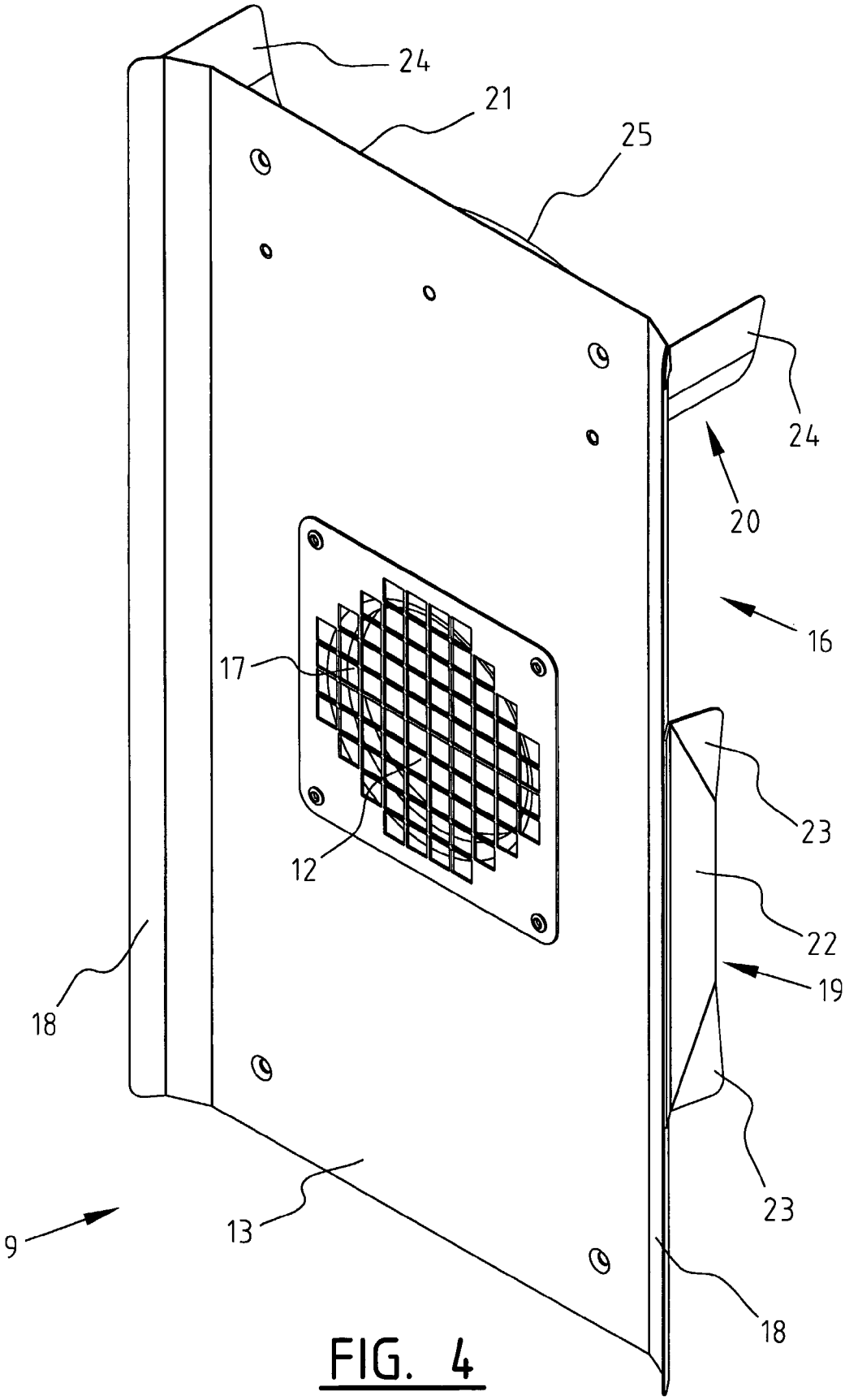
Figures 5A, 5B, 5C:
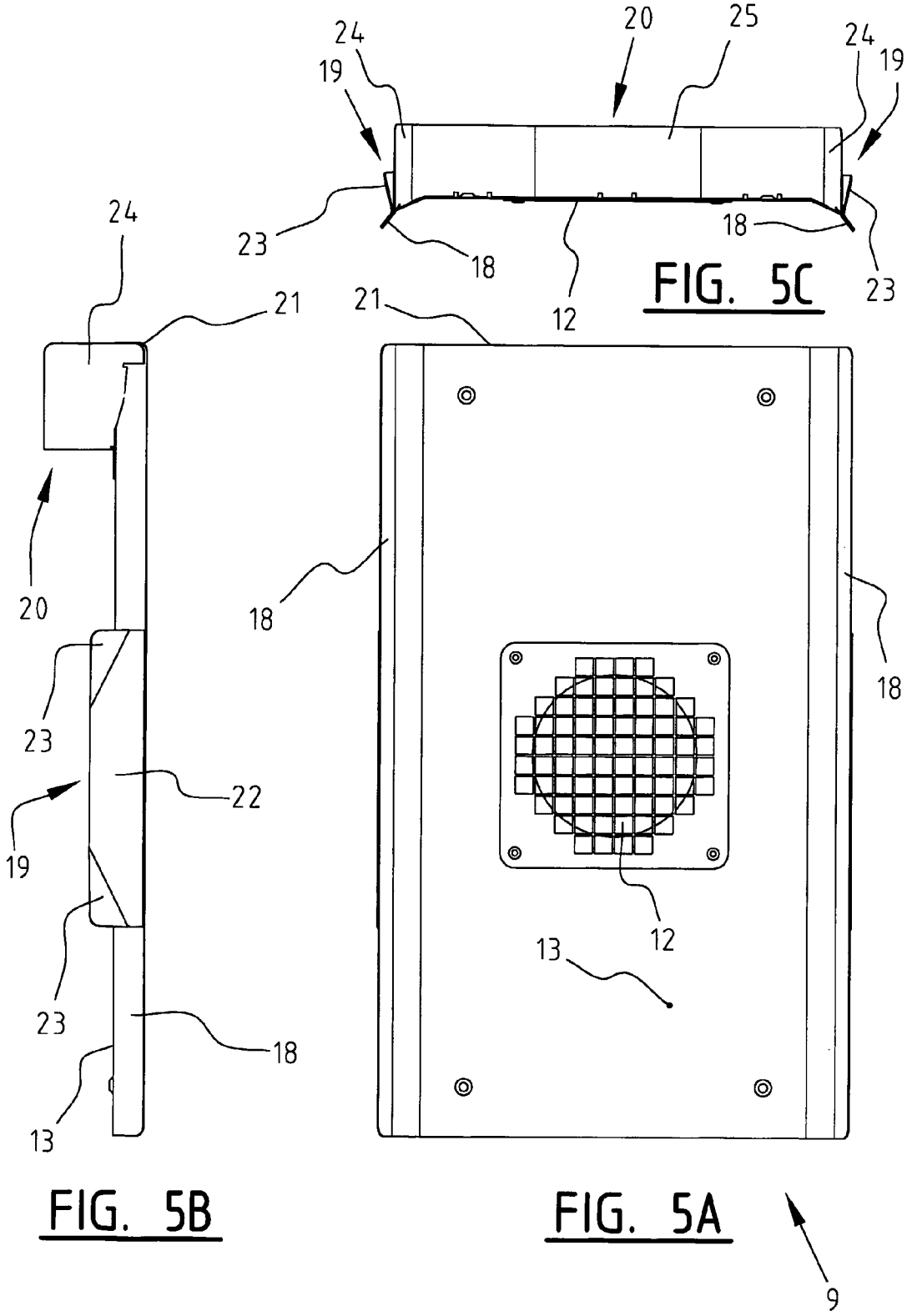

The invention is now elucidated on the basis of an exemplary embodiment, wherein reference is made to the accompanying drawing, in which:

FIGS. 1 and 2 show respectively a vertical and a horizontal longitudinal section through an oven having therein a separating wall formed in accordance with the principles of the invention, FIG. 3 is a perspective view of the separating wall as seen from the position of the fan, FIG. 4 is a perspective view of the separating wall as seen from the preparation space, and FIGS. 5A, 5B and 5C show respectively a front view, a side view and a top view of the separating wall with uniformity enhancing means according to the invention.

An oven 1 according to the present invention comprises a housing 2 in which is formed a preparation space 3. Preparation space 3 is bounded by two side walls 4, an upper wall 5, a bottom 6 and a rear wall 7. The open side of preparation space 3 opposite rear wall 7 is closed with a door 8 suspended hingedly from housing 2. Placed some distance in front of rear wall 7 is a separating wall 9 which is formed substantially by a flat plate 13 but which, compared to separating walls in conventional ovens, has a number of modifications as discussed below.

One or more electrical heating elements 10 are arranged against rear wall 7, as well as a fan 11 with which air can be drawn out of preparation space 3 and blown along heating elements 10 and back into preparation space 3. Separating wall 9 is provided for this purpose with a suction opening 12 formed opposite fan 11, and this wall 9 is clear of the peripheral walls 4-6 of preparation space 3, so that outlet slots 14, 15 are defined therebetween.

During use of the oven prepacked meals for heating are placed stacked in racks (not shown here) in preparation space 3, whereafter door 8 is closed and the oven started. Air is herein blown, after heating thereof, along the peripheral edges of separating wall 9 into preparation space 3 (arrows B), while cooled air is drawn out of preparation space 3 through the central suction opening 12 (arrow C). The air circulation in preparation space 3 is adversely affected by the presence of the meals, which are packed together as closely as possible for optimum utilization of the capacity of oven 1.

In order to nevertheless achieve a uniform distribution of the hot air over the whole content of the oven, the separating wall 9 is provided according to the invention with means 16 for enhancing the uniformity of the hot airflow in preparation space 3. These uniformity enhancing means 16 comprise a number of flow engineering provisions for combined or individual use.

Formed downstream of suction opening 12 in separating wall 9 there is thus a throat 17 which is defined by a peripheral edge arranged around suction opening 12 and directed toward fan 11. The suction of air out of preparation space 3 by fan 11 is hereby improved, and flow losses, which would result in irregularities in the flow, are reduced as far as possible.

In addition or instead, the vertical end edges 18 of separating wall 9 can have a form curved or bent toward preparation space 3 relative to the flat plate 13. As stated, these curved or bent end edges 18 ensure that the flow direction of hot air flowing through outlet slots 14 to preparation space 3 is gradually deflected, whereby pressure losses remain limited and turbulence is prevented.

In the shown embodiment of the invention the uniformity enhancing means 16 further comprise three flow guides 19, 20 which extend along edges of separating wall 9 and which are directed away from preparation space 3. Two these flow guides 19 extend substantially vertically along the curved end edges 18 of flat plate 13, while the third flow guide 20 extends substantially horizontally along the upper edge 21 of separating wall 9.

The vertical guides 19 cover only a part of the height of wall 9 and are situated adjacently of fan 11, while horizontal guide 20 covers the whole width of wall 9. Each of the vertical flow guides 19 has a middle part 22 which lies roughly perpendicularly of plate 13 and end portions 23 fanning out at the top and bottom toward the side wall 4 of preparation space 3. The horizontal flow guide 20 also has end portions 24 which fan out, although these bend away in vertical direction, thus toward upper wall 5 of preparation space 3, but are directed transversely of the plane of plate 13. This guide 20 further has a middle part 25 which arches upward such that guide 20 as a whole has a wave shape.

This combination of flow guides 19, 20 achieves that the air at those points of end edges 18 or upper edge 21 lying closest to fan 11 is deflected, and must therefore travel over a longer path than the air blown out along the corner points of wall 9. The uniformity of the flow is hereby improved.

Although the invention is elucidated above with reference to an exemplary embodiment, it will be apparent that it is not limited thereto. The form of the separating wall, the location of the fan and the specific embodiment of the uniformity enhancing means could thus all be varied. The scope of the invention is therefore defined solely by the claims which follow.

The invention claimed is:

1. An oven for use in an aircraft, the oven comprising; a preparation space, an air circulation device that causes circulation of air through the preparation space, and a heating device co-acting with the air circulation device that heats the circulation air, wherein the air circulation device comprises at least one fan and at least one separating wall placed between the fan and the preparation space, wherein the separating wall is a substantially fiat plate having one side facing the preparation space and an opposite side facing away from the preparation space, the separating wall further having an airflow uniformity enhancing device that enhances the uniformity of hot airflow in the preparation space, wherein the airflow uniformity enhancing device includes at least one horizontal flow guide on the side of the fiat plate that faces away from the preparation space, the at least one flow guide extending substantially transversely of the separating wall along an upper edge thereof and directed away from the preparation space, such that heated air can flow round the edge of the separating wall only at determined locations, the at least one horizontal flow guide comprises an undulating contour; the airflow uniformity enhancing device further including at least one vertical guide located on a side of the flat plate and extending in the direction of the at least one flow guide, the vertical flow guide having a middle portion and bent side portions located on opposite sides of the middle portion.

2. The oven as claimed in claim 1, wherein the at least one flow guide is placed substantially at the position of the fan.

3. The oven as claimed in claim 1, wherein the at least one flow guide has a middle part extending substantially transversely of the separating wall and at least one end part which fans out.

4. The oven as claimed in claim 1, wherein the at least one flow guide extends substantially vertically along an edge of the separating wall.

5. The oven as claimed in claim 4, wherein the at lest one flow guide extends over only a part of the height of the separating wall.

6. The oven as claimed in claim 1, wherein the at least one flow guide extends substantially horizontally along an upper edge of the separating wall.

7. The oven as claimed in claim 6, wherein the at least one flow guide extends substantially over the whole width of the separating wall.

8. The oven as claimed in claim 6, wherein the at least one flow guide has a wave-like progression.

9. The oven as claimed in claim 1, wherein the separating wall has at least one opening for drawing air out of the preparation space, and the airflow uniformity enhancing device further includes a throat connected to the at least one opening.

10. The oven as claimed in claim 1, wherein the separating wall extends substantially vertically and the airflow uniformity enhancing device further includes end edges of the separating wall which run close to side walls of the preparation space and which have a form curved or bent toward the preparation space relative to a main place of the separating wall.

11. A separating wall for use in an aircraft oven, the separating wall being between a fan and a preparation space, said separating wall being a substantially fiat plate having one side facing the preparation space and an opposite side facing away from the preparation space, the separation wall further having an airflow uniformity enhancing device that enhances the uniformity of hot airflow in the preparation space, wherein the airflow uniformity enhancing device further includes at least one horizontal flow guide connected to the side of the fiat plate that faces away from the preparation space, the at least one flow guide extending substantially transversely of the separating wall along an upper edge thereof and directed away from the preparation space, such that hot airflow round the edge of the separating wall is only possible at determined locations, the at least one horizontal flow guide comprises an undulating contour; the airflow uniformity enhancing device further including at least one vertical guide located on a side of the flat plate and extending in the direction of the at least one flow guide, the vertical flow guide having a middle portion and bent side portions located on opposite sides of the middle portion.

12. The separating wall as claimed in claim 11, wherein the at least one flow guide is placed substantially at the position of the fan.

13. The separating wall as claimed in claim 11, wherein the at least one flow guide has a middle part extending substantially transversely of the separating wall and at least one end part which fans out.

14. The separating wall as claimed in claim 11, wherein the at least one flow guide extends substantially vertically along an end edge of the separating wall.

15. The separating wall as claimed in claim 14, wherein the at least one flow glow guide extends over only a part of the height of the separating wall.

16. The separating wall as claimed in claim 11, wherein the at least one flow guide extend substantially horizontally along an upper edge of the separating wall.

17. The separating wall as claimed in claim 16, wherein the at least one flow guide extends substantially over the whole width of the separating wall.

18. The separating wall as claimed in claim 16, wherein the at least one flow guide has a wave-like progression.

19. The separating wall as claimed in claim 11, wherein the separating wall has at least one opening for drawing air out of the preparation space, and the airflow uniformity enhancing device further includes a throat connected to the at least one opening.

20. The separating wall as claimed in claim 11, wherein the separating wall extends substantially vertically and the airflow uniformity enhancing device further includes end edges of the separating wall which run close to side walls of the preparation space and which have a form curved or bent toward the preparation space relative to a main plane of the separating wall.

* * * * *